US005172828A

United States Patent [19]

Ficken et al.

[11] Patent Number: 5,172,828

[45] Date of Patent: Dec. 22, 1992

[54] CUP DISPENSER

[75] Inventors: Leonard A. Ficken, Manchester; Gerald J. Podgorny, St. Louis, both of Mo.

[73] Assignee: UniDynamics Corporation, New York, N.Y.

[21] Appl. No.: 769,552

[22] Filed: Oct. 1, 1991

[51] Int. Cl.[5] ..... G07F 11/12

[52] U.S. Cl. ..... 221/11; 221/17; 221/113; 221/105

[58] Field of Search ..... 221/11, 103, 105, 96, 221/17, 113, 104, 121, 133

[56] References Cited

U.S. PATENT DOCUMENTS

| | | | |
|---|---|---|---|
| 2,394,262 | 2/1946 | Reifsnyder et al. | 221/11 |
| 3,283,951 | 11/1966 | Gladfelder | 221/11 |
| 4,632,274 | 12/1986 | Garbe | 221/96 |
| 4,989,753 | 2/1991 | Brogna et al. | 221/121 |
| 5,044,517 | 9/1991 | U Park | 221/11 |

FOREIGN PATENT DOCUMENTS 2226551A 4/1990 United Kingdom .

*Primary Examiner*—Robert P. Olszewski
*Assistant Examiner*—Dean A. Reichard
*Attorney, Agent, or Firm*—Senniger, Powers, Leavitt & Roedel

[57] ABSTRACT

A cup dispenser for dispensing cups from a stack of nested cups each of which has a rim wherein the stack being dispensed is held up in dispensing position in a dispensing opening, the lowermost cup of the stack being released to drop down and the next cup being held up to hold up the remainder of the stack, first and second reverse stacks being held adjacent the opening, one or the other of these reserve stacks being moved into dispensing position in the dispensing opening in response to depletion of the stack in dispensing position.

18 Claims, 10 Drawing Sheets

CUP DISPENSER

BRIEF SUMMARY OF THE INVENTION

This invention relates to cup dispensers, and more particularly to a dispenser for use in a beverage vending machine for dispensing cups from stacks of nested cups.

The invention is especially directed to cup dispensers of the type in which cups are dispensed from a stack of nested cups at a cup dispensing station and wherein a reserve stack is automatically moved to the dispensing station when the stack at the dispensing station is depleted for continuing cup dispensing operations. Reference may be made to U.S. Pat. Nos. 4,215,801, 4,351,452, and 4,635,816 for dispensers of this general type.

Among the several objects of the invention may be noted the provision of a cup dispenser of the stated type which is adapted to hold a relatively high number of cups, including a plurality of cups in a stack at a dispensing station and a plurality of cups in a plurality of reserve stacks, and to deliver a reserve stack to the dispensing station when the stack which was at a dispensing station is depleted; the provision of such a dispenser which is of relatively simplified, economical, compact construction having a single cup dispensing station and two reserve stack mechanisms, each holding a plurality of reserve stacks; the provision of such a dispenser which is operable reliably to deliver reserve stacks to the dispensing station without jamming; and the provision of cup dispenser apparatus adapted for dispensing cups of either of two sizes, with reserve stacks of cups of each of the two sizes.

In general, a cup dispenser of this invention, for dispensing cups from a stack of nested cups each of which has a rim, comprises a base having a cup dispensing opening and dispensing means at the opening for holding up the lowermost cup of a stack in dispensing position by the rim of the lowermost cup in the opening and thereby holding up the stack in dispensing position generally in line with the opening. The dispensing means is operable to release the lowermost cup of the stack in dispensing position to drop down out of the dispenser and to hold up the next cup by its rim and thereby hold up the remainder of the stack. The dispenser further comprises first means for holding a first reserve stack adjacent the opening, second means for holding a second reserve stack adjacent the opening, and means operable in response to depletion of the stack in dispensing position to move one or the other of the reserve stacks into dispensing position with the rim of the lowermost cup engaging the dispensing means.

Other objects and features will be in part apparent and in part pointed out hereinafter.

BRIEF DESCRIPTION OF THE DRAWINGS

Corresponding reference characters indicate corresponding parts throughout several views of the drawing.

DETAILED DESCRIPTION

Figure 1:
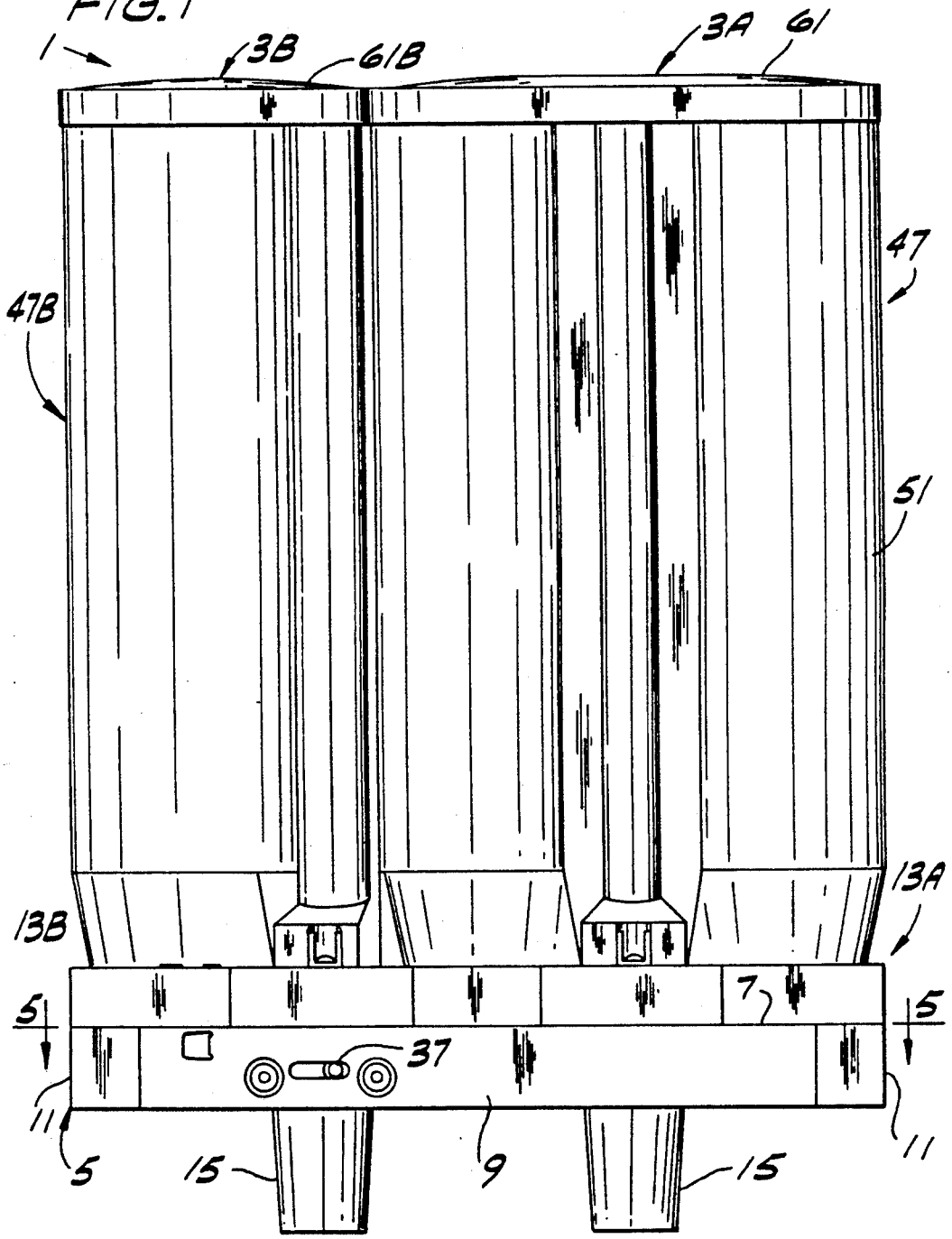
FIG. 1 is a view in side elevation of a dual dispenser of this invention.
Figure 2:
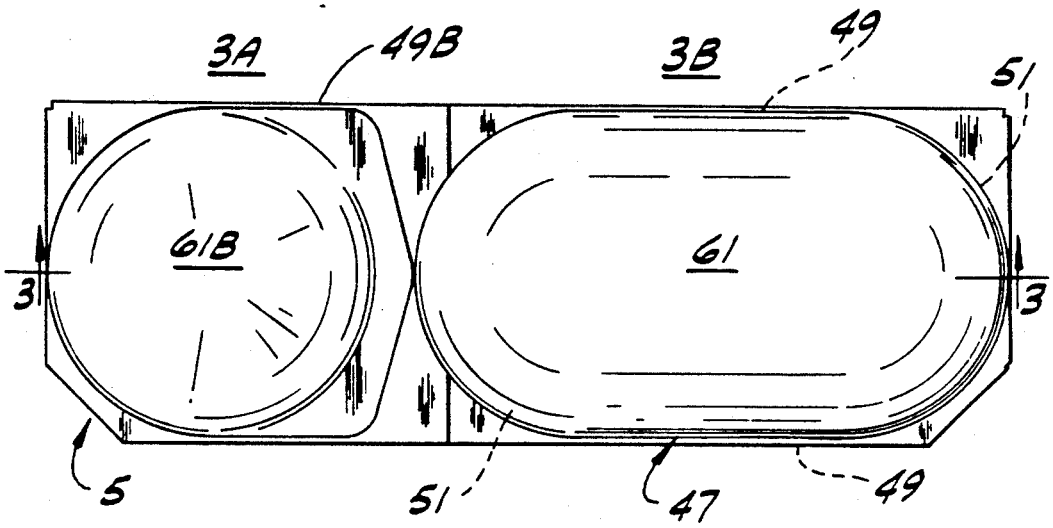
FIG. 2 is a view in plan of the dispenser.

Referring to the drawings, a dual cup dispenser apparatus of this invention for dispensing two different sizes of cups is designated in its entirety by the reference numeral 1. It comprises a first dispenser 3A for cups of a first size and a second dispenser 3B for cups of either the first or a second size. The two dispensers 3A and 3B have a common base, generally designated 5, comprising a generally rectangular plate 7 having downwardly extending side and end flanges 9 and 11 and an assembly of parts on top of the plate forming a compartmented cover structure 13A for that portion of the base included in dispenser 3A and a compartmented cover structure 13B for that portion of the base included in dispenser 3B.

Figure 4:
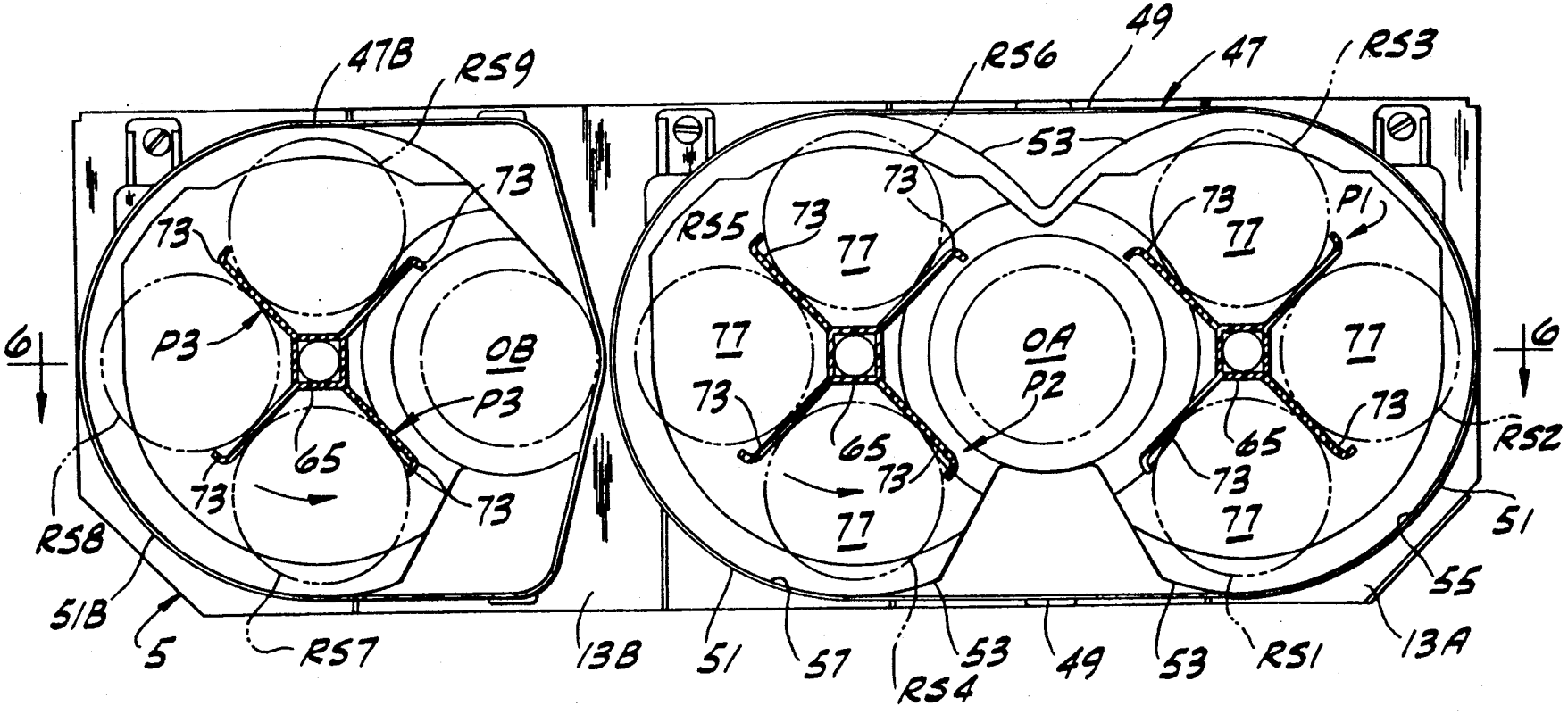
FIG. 4 is a horizontal section generally on line 4—4 of FIG. 3.

The first cup dispenser 3A is adapted for dispensing cups 15 each having a rim 17 from a stack of the cups wherein the cups are nested, the cups generally being of a size to be more frequently dispensed. The second cup dispenser 3B may hold the same size, or another size. For the dispensing of cups from dispenser 3A, the cover structure 13A and the base plate 7 are made to provide an opening 0A (see FIGS. 4–6) for the stack of cups to be dispensed. This opening has an upper part 21 in the cover structure 13A tapered downwardly and inwardly at its upper end as indicated at 23 for guiding a stack down in the opening, and includes an opening 25 in the base plate 7 with which part 21 registers. The opening 0A defines a cup dispensing station, also denoted 0A, for the dispenser 3A.

A cup ring 27A is secured to the bottom of the top plate 7 concentric with the opening 0A, the opening 29 in the ring registering with the opening 0A. The cup ring, as herein illustrated, is basically similar to the cup ring disclosed in U.S. Pat. No. 4,426,017 issued Jan. 17, 1989, which is incorporated herein by reference. A stack S1 of cups is held up in dispensing position at the dispensing station 0A by engagement of the rim 17 of the lowermost cup of the stack with escapement members 19 of the cup ring. These escapement members are rotatable to release the lowermost cup of the stack S1 to drop down away from the base and to hold up the next cup in the stack by its rim and thereby hold up the stack in the dispensing position. Rotation of the escapement members 19 is by operation of a lever 37 via gearing of the cup ring mechanism (see FIG. 5). Details of the cup ring may be ascertained from the aforesaid U.S. Pat. No. 4,426,017 and will not be repeated here. It will suffice to say that swinging of the lever in one direction from a retracted position rotates the escapement members in one direction to release the lowermost cup. On return of the lever to its retracted position, the escapement members rotate back to retracted position and the stack S1 drops down in opening 0A to the point where the rim of the next cup engages shoulders 61 of members 19, all as disclosed in U.S. Pat. No. 4,426,017. The cup ring is adjustable for holding stacks of cups for different sizes as detailed in said U.S. Pat. No. 4,426,017.

Dispenser 3A further comprises means indicated generally at 41 for holding a first set of three reserve stacks RS1, RS2 and RS3 adjacent the dispensing opening 0A and means indicated generally at 43 for holding a second set of three reserve stacks RS4, RS5 and RS6, and means indicated generally at 45 operable in response to depletion of the stack S1 in dispensing position in the opening 0A for moving a reserve stack of one or the other of the first or second sets into dispensing position with the rim 17 of the lowermost cup of the fresh stack engaging the escapement members 19 of the cup ring 27A. Thus, for example, with a stack S1 in dispensing position at the dispensing station 0A, and reserve stacks awaiting delivery to the dispensing station 0A, in response to depletion of the stack S1, the reserve stack RS1 is advanced one step forward into dispensing position at station 0A, and reserve stacks RS2 and RS3 are advanced one step for subsequent delivery to dispensing position. In response to depletion of the fresh stack (which was RS1) at the dispensing station 0A, the reserve stack RS2 is advanced one step into dispensing position at the dispensing station, and reserve stack RS3 is advanced one step for subsequent transfer to dispensing position. And in response to the depletion of the fresh stack (which was RS2), the reserve stack RS3 is advanced one step to dispensing position. The operation is essentially similar for reserve stacks RS4–RS6. The reserve stacks are delivered to dispensing position before the last few cups are dispensed, e.g. when six cups are all that are left.

Each of the reserve stack holding means 41 and 43 may be referred to as a turret. At 47 is illustrated a housing or canister which is common to the two turrets. This is mounted on top of the base cover structure 13A extending upward therefrom. It has straight side walls 49 and semicircular end walls 51 thereby being generally oval in horizontal cross section. Within the canister are curved walls 53 which in conjunction with the end walls define two vertical cylindrical chambers 55 and 57. These are located at diametrically opposite sides of the opening 0A. Walls 53 terminate at the opening 0A so that each of chambers 55 and 57 is open at the side toward the opening 0A. The canister is open at the bottom, and has a lid 61.

Figure 3:
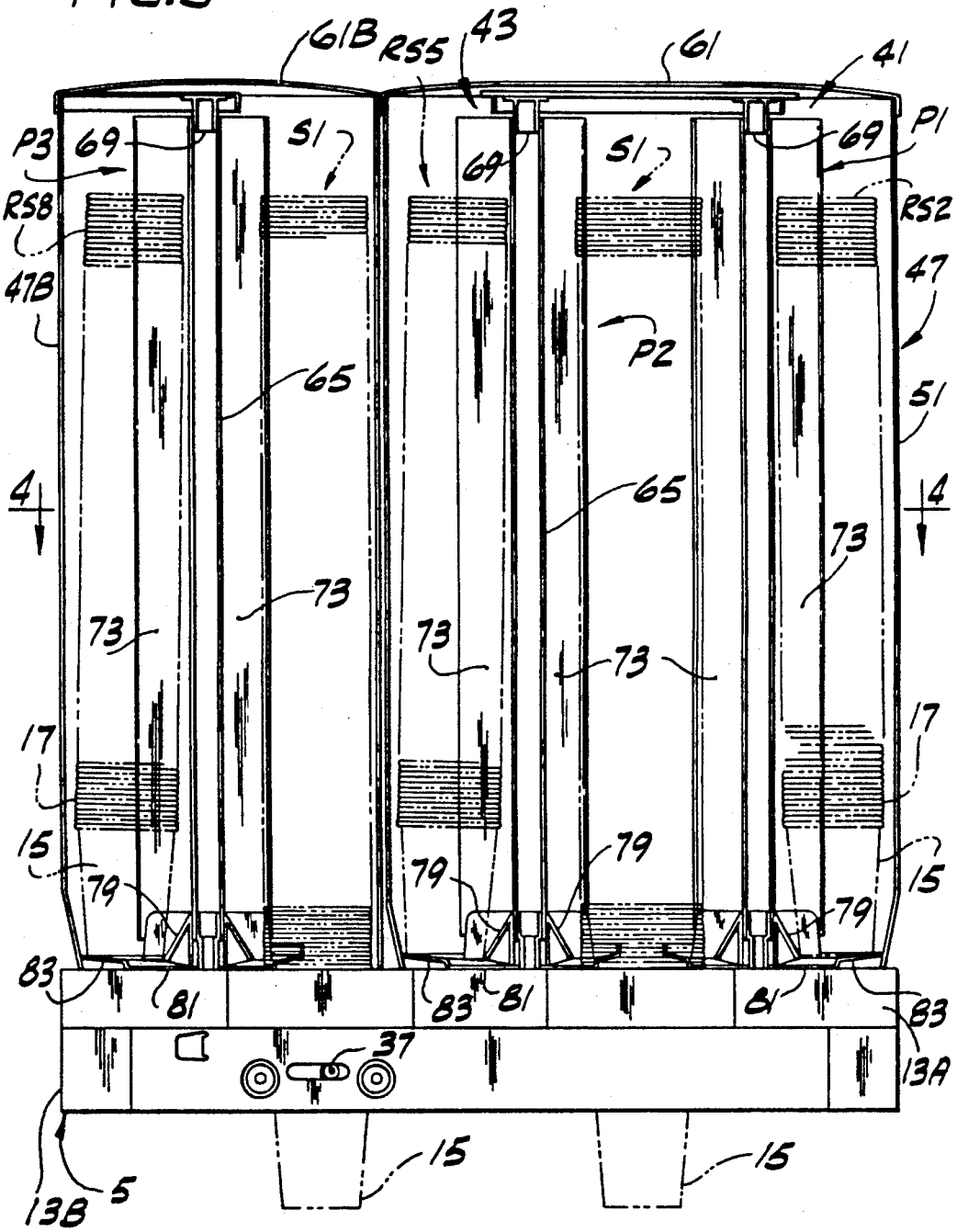
FIG. 3 is a vertical section generally on line 3—3 of FIG. 2.

Extending vertically upward from the base in each chamber 55 and 57 is a rotary reserve stack pusher means designated in its entirety by the reference character P, one of which is specifically designated P1 and the other P2. Each of these may also be referred to as a magazine, since it holds a number of reserve stacks. Each resembles a revolving door, comprising a tubular shaft 65 of square cross section journalled at its lower end as indicated at 67 in FIG. 6 in the base and at its upper end as indicated at 69 on a member 69 carried by a bracket 70 mounted at the upper end of the canister, and four vanes or partitions (pushers) each designated 73 extending radially outwardly from the shaft 65 spaced at 90° intervals around the shaft. The four V-shaped spaces between the four partitions vanes are indicated at 77, each space constituting a chamber adapted to receive a reserve stack RS of nested cups extending upwardly therein. At the lower end of each rotary pusher P in each space 77 is an inclined guide 79. Each reserve stack RS of cups extends upwardly in the respective space 77, its lower end being held away from the center shaft 65 by the guide 79 and bearing on the rim of a bottom plate 81 secured on the base centered with respect to the shaft. The plate 81 is of circular outline, having a raised rim 83 and a cut-out 85 registering with the opening 0A. With the inclined guide 79 and the raised rim 83 on the plate 81, each reserve stack is held in the respective space 77 slightly inclined upwardly and inwardly to minimize its contact with the canister, thereby to minimize friction between the reserve stacks and the canister (see FIG. 3). The arrangement is such that on rotation of the pusher 1 to bring each space 77 into registry with the opening 0A, the stack in that space is pushed around to drop down out of the space into the opening 0A and drops down in 0A into the remainder of the stack in 0A (e.g. the last six cups). The rim 83 of the plate is formed with guides 83*a* for guiding the reserve stack into said remainder of the stack in 0A. Each holder or pusher means P1, P2 may be referred to as a magazine since it holds a number, specifically three reserve stacks.

Figure 10:
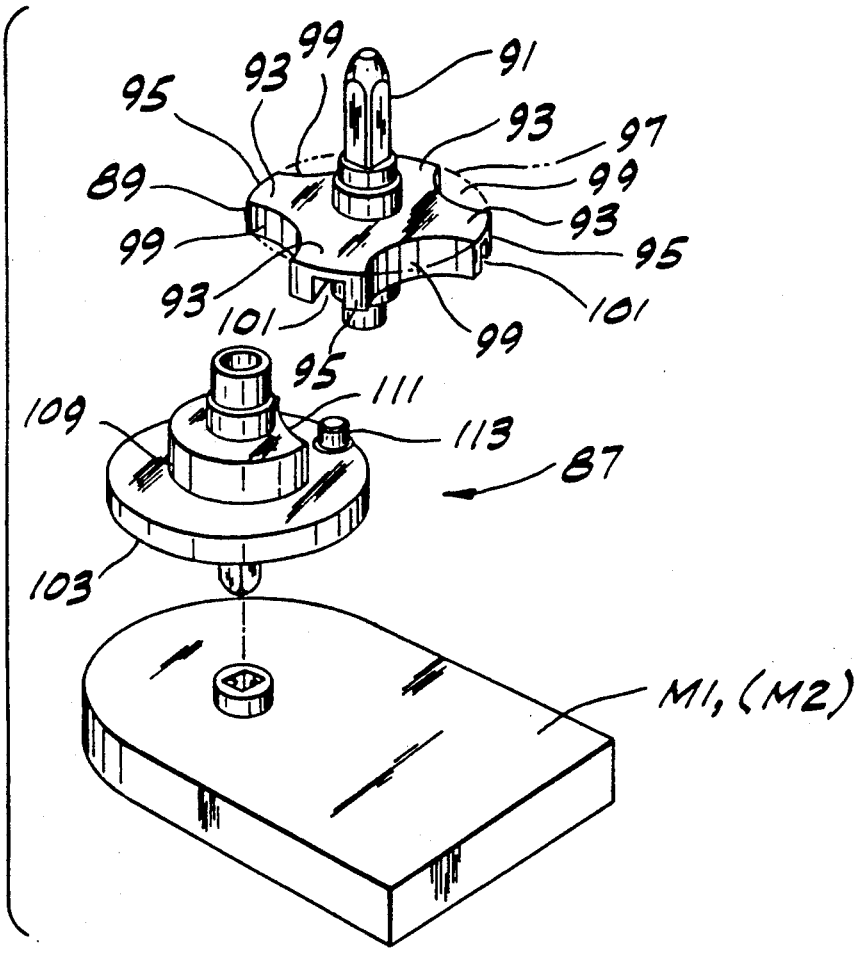
FIG. 10 is an exploded view illustrating a Geneva drive mechanism of the apparatus.

Each of the rotary pushers P with the partitions 73 spaced at 90° intervals there around is adapted to be indexed in 90° steps successively to bring each space 77 (and the reserve stack therein) to the stack drop position generally in register with the opening 0A by means comprising an electric motor and a Geneva indexing mechanism driven by this motor. The motor for the rotary pusher P1 in chamber 55 is designated M1 and the motor for the rotary pusher P2 in chamber,, 57 is designated M2. The Geneva drive mechanism (see FIG. 10) for each rotary pusher is designated in its entirety by the reference numeral 87. It comprises an index wheel 89 having a center stub shaft 91 of square cross section extending up into the lower end of the rotary pusher shaft 65. The index wheel has four radially extending arms 93 spaced at 90° intervals, these arms having arcuate end surfaces 95 on a circle having a diameter 97, and four arcuate recesses each designated 99 in its periphery spaced at 90° intervals. Each arm has a radial groove 101 in the bottom. The Geneva mechanism further comprises a drive wheel 103 having a center shaft 105 by means of which it is driven by the motor therefor for rotation on a vertical axis. The drive wheel has a portion 109 of circular outline having a recess 111 with a curved base curved on an arc having the same radius as that of the curved end surfaces 95 of the index wheel. Wheel 103 has a pin 113 extending upwardly adjacent its periphery in the central vertical plane of the recess 111 in the disk.

The Geneva drive motor (M1 or M2) rotates the Geneva drive wheel 103 through one revolution on each cycle of operation of the motor and the Geneva drive mechanism. During the revolution of the wheel 103, the pin 113 enters the groove in one of the arms 93 of the index wheel 89 and rotates the latter through one quarter of a revolution (i.e through 90°) thereby to index the respective rotary pusher or magazine P through 90°. Portion 109 of the drive wheel is initially positioned in a recess 99 in the index wheel, locking the index wheel in position, and rotates around in the recess 99 while the index wheel remains fixed, until the pin 113 enters the groove in one of the arms 93 of the index wheel to rotate the index wheel one-quarter turn. Then portion 109 comes into position in a recess 99 in the index wheel to lock the latter in its moved position.

Thus, on each cycle of operation of the Geneva drive motor (M1, M2) the rotary pusher or magazine (P1, P2) is indexed forward one 90° step.

Figure 5:
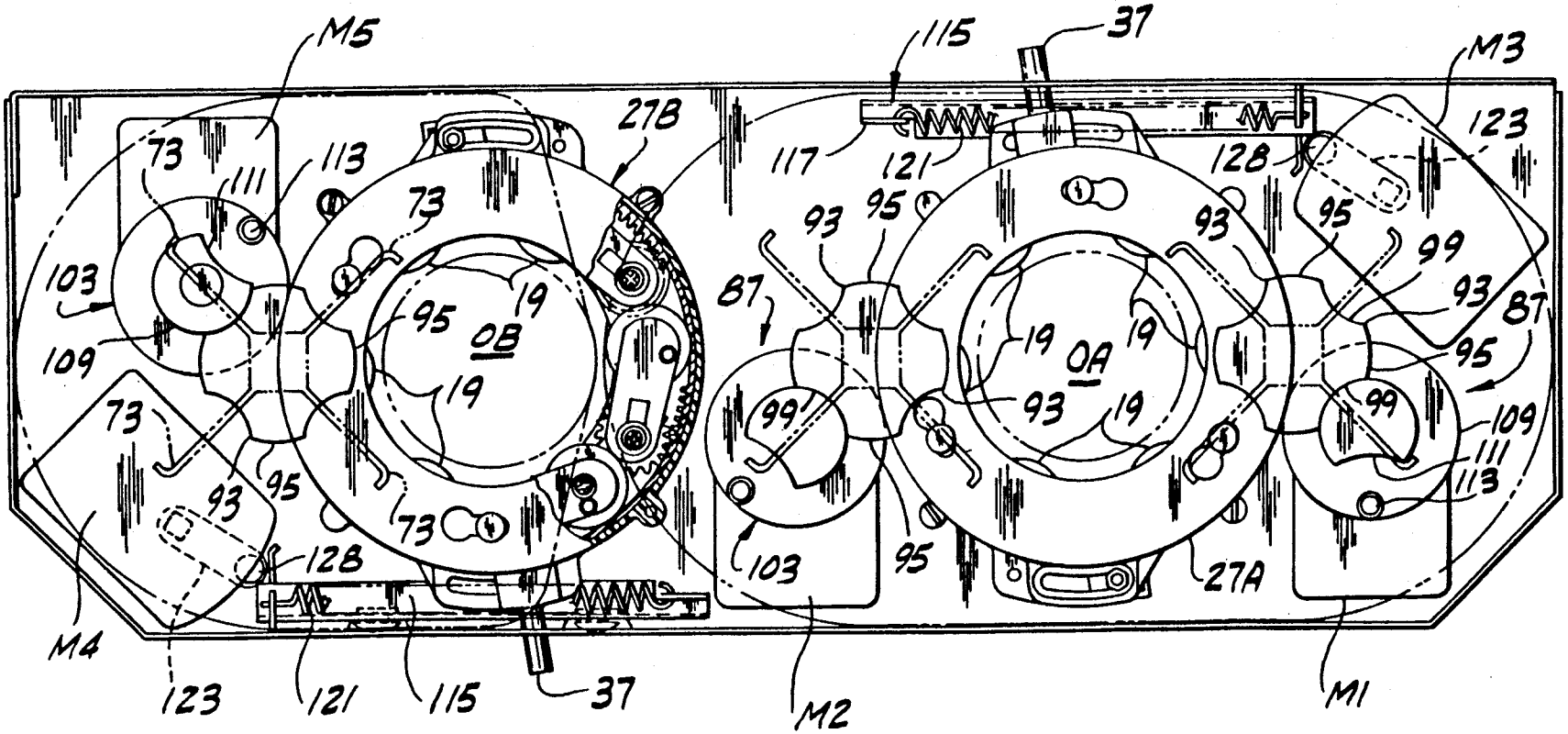
FIG. 5 is a horizontal section generally on line 5—5 of FIG. 1.
Figure 6:
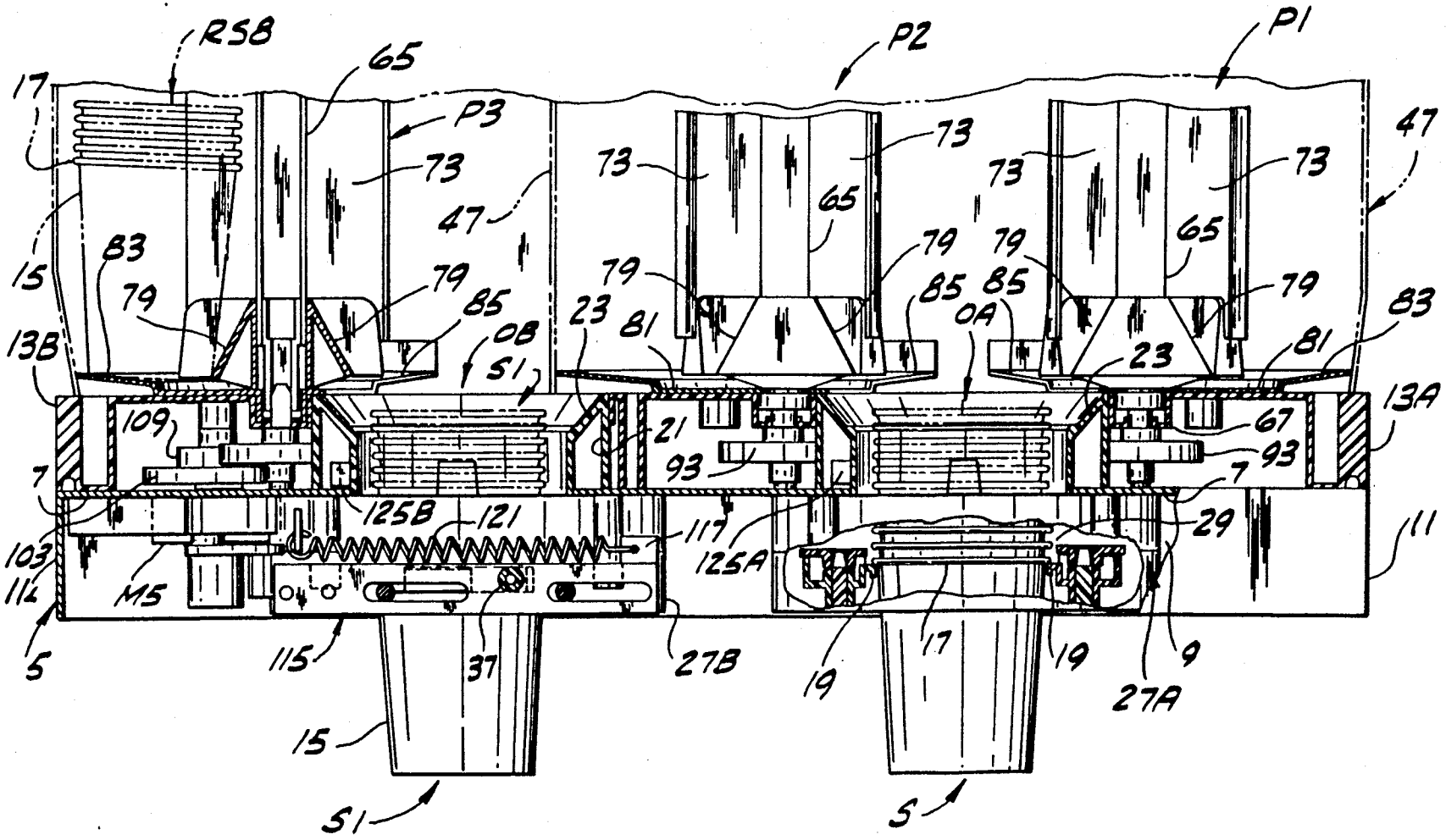
FIG. 6 is a vertical section with parts broken away to reduce the height of the view taken generally on line 6—6 of FIG. 4.
Figure 7:
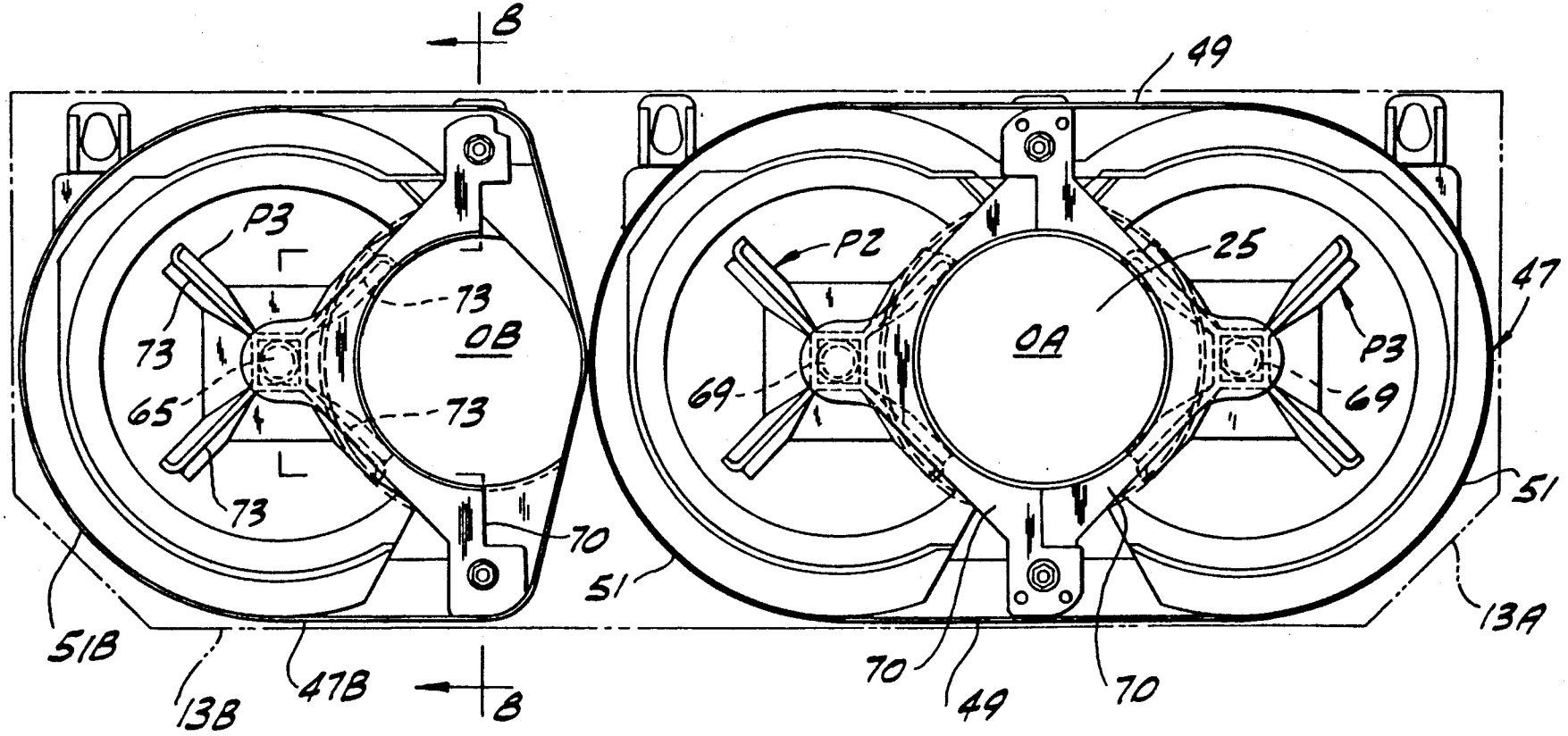
FIG. 7 is a plan view with certain canister lids, removed.
Figure 8:
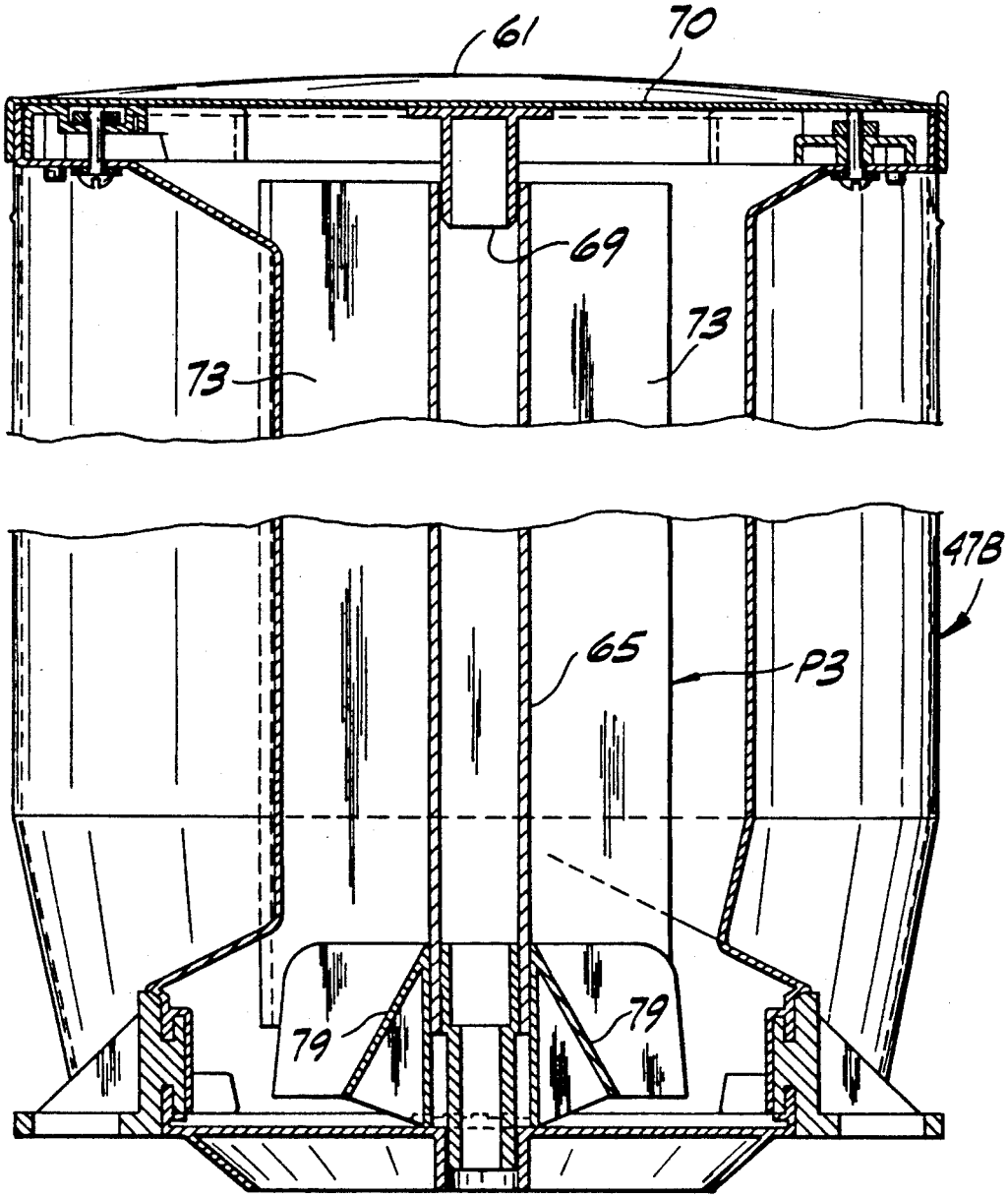
FIG. 8 is a vertical section on line 8—8 of FIG. 7.
Figure 9:
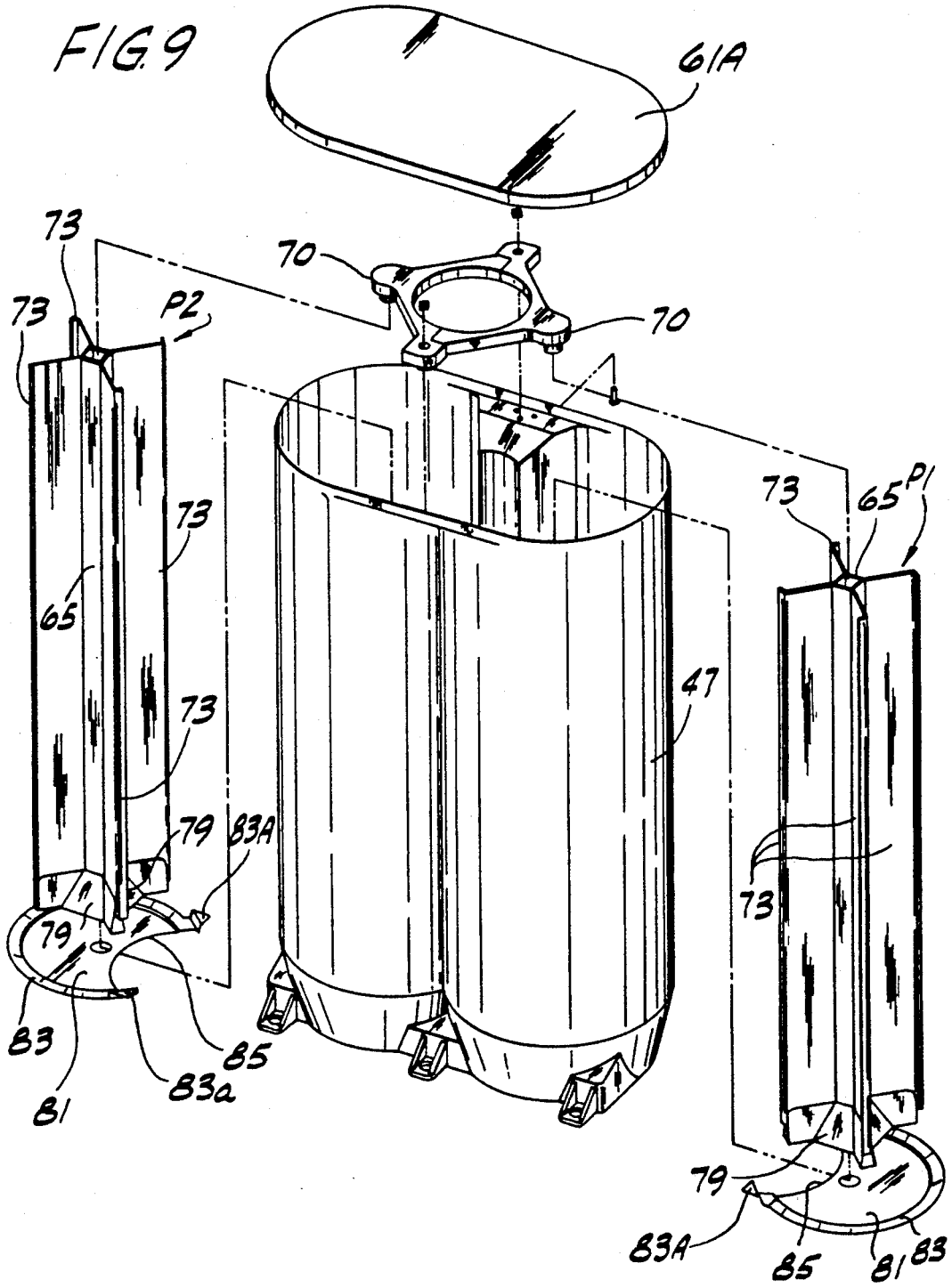
FIG. 9 is an exploded view showing a canister, reserve stack pushers and reserve stack support plate of the apparatus.

The cup ring 27A is operated by means indicated generally at 115, comprising a slide bar 117 carried by the base structure for sliding movement relative to the base structure away from and back to a retracted position such as illustrated in FIG. 5, the slide bar being connected to the cup ring lever 37 as indicated at 119. The slide bar is biased by a spring 121 to its retracted position and is adapted to be moved away from its retracted position for swinging the cup ring lever 37 to actuate escapement members 19 of the cup ring to release the lowermost cup of the stack in dispensing position by an electric motor M3 driving a crank 123 engaging the slide bar 117 as indicated at 128. The arrangement is such that on operation of the motor M3 for one revolution of the crank 123, the slide bar 117 is first moved forward against the bias of spring 121 by the crank away from its retracted position, during a first part of the revolution, and then returned by the spring to retracted position during a second part of the revolution.

The dispenser 3B corresponds essentially to the dispenser 3A. except that it has only one rotary reserve stack pusher P3 corresponding to the pusher P1 and P2 of dispenser 3B, this pusher holding three reserve stacks RS7, RS8 and RS9, and an opening 0B and a cup ring 27B corresponding to opening 0A and cup ring 27A of dispenser 3A. The motor for actuating the cup ring 27B of dispenser 3B is designated M4, and the motor for indexing the reserve stack pusher of dispenser 1B is designated M5. The canister and lid for dispenser 3B are designated 47B and 61B.

Figure 11:
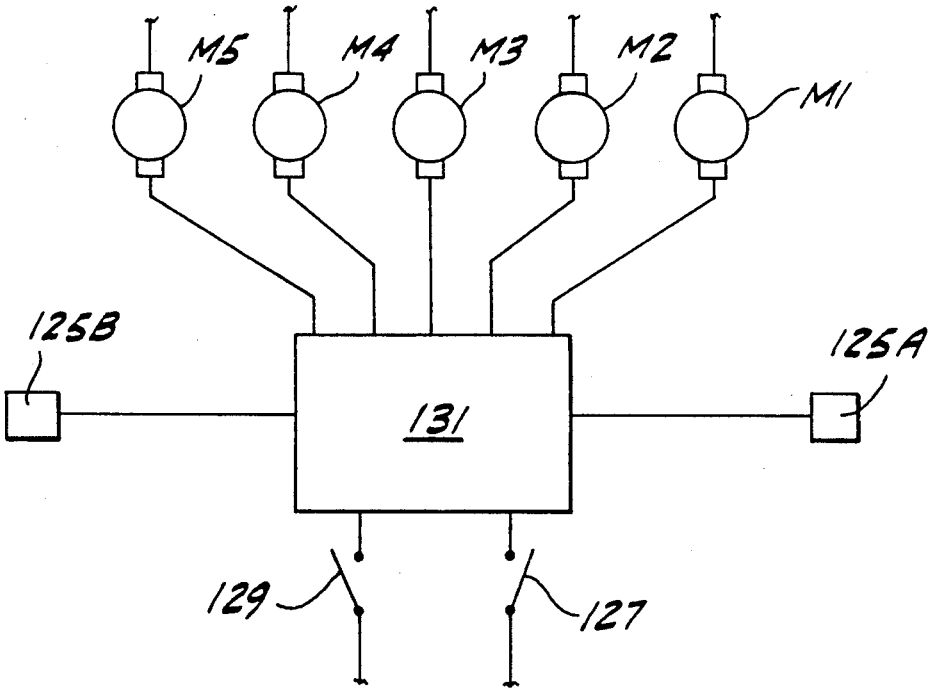
FIG. 11 (sheet 2) is a circuit diagram.

The dispenser 1 is mounted on the inside of the door of the cabinet of a beverage (e.g. coffee) vendor (not shown) with the arrangement such that in dispensing of a cup from either of the two dispensers 3A or 3B the cup is guided to a beverage delivery station in a recess in the door. The dispenser 1 may have its base suitably hingedly mounted on the door for being swung out when the door is opened to a position convenient for loading the two reserve stack pushers P1 and P2 of turrets 41 and 43 of dispenser 1A with reserve stacks RS1-RS6, (dispenser 1A) and for loading the pusher P3 of dispenser 1B with reserve stacks RS7-RS9. Infra red sensors 125A and 125B (see FIGS. 6 and 11) are provided at stations 0A and OB for sensing the depletion of a stack at 0A and OB down to a small number, e.g. six, of cups. The vendor includes two switches such as indicated at 127 and 129 in FIG. 11, one of which is closed on selection of a vend calling for a first or A size of cup (e.g. an 8-¼oz. cup), and the other of which is closed on selection of a vend calling for the second or B size of cup (e.g. a 12 oz. cup).

Assuming that there is a stack S1 of A size cups in dispensing position at the 0A dispensing station, three reserve stacks RS1, RS2 and RS3 of the A size in one of the reserve stack pusher P1 of dispenser 3A, three reserve stacks RS4, RS5 and RS6 of the A size in the other reserve stack pusher P2 of dispenser 1A, a stack S1 of B size cups in dispensing position at the OB station, and three reserve stacks RS7, RS8 and RS9 of the B size cups in the reserve stack pusher P3 of dispenser 1B, operation is generally as follows:

On selection of a vend calling for an A size cup, switch 127 closes and signals a programmable controller 131 to operate the motor M3 for actuating the cup ring 27A of dispenser 3A. The motor operates for one revolution of the crank 123 and this drives slide bar 117 to swing the lever 37 of the cup ring 27A to drop the lowermost cup 15 of the stack S1A. When the stack S1 is depleted, the infra red sensor 125A signals the controller 131 to operate the motor M1 for indexing the reserve stack pusher P1 one 90° step to deliver the reserve stack RS1 to the dispensing station 0A, the stack RS1 sliding down and out of its chamber in the rotary pusher P1 into the opening 0A and dropping down therein into the remainder of the stack S1. Reserve stacks RS2 and RS3 are pushed forward (indexed) one step forward in their circular path of travel around the axis of revolution of the reserve stack pusher P1, bringing RS2 to the position ready for the next reserve stack delivery. It will be observed that the circular path intersects opening 0A. Further vends calling for A cups take place from the remaining cups from the stack at 0A and then from the fresh stack S1A (which was stack RS1) in dispensing position at 0A until that stack is depleted, whereupon the infra red sensor 125A signals the controller 131 to operate motor M2 for indexing the pusher P2 one step to deliver the reserve stack RS4 to the dispensing station 0A, the stack sliding down and out of its chamber in the pusher P2 into the opening 0A and dropping down into the remaining cups at 0A. Reserve stacks RS5 and RS6 are indexed forward one step, bringing stack RS5 into ready position. Further vends calling for A cups take place from the remaining cups of the last stack at 0A until that stack is depleted whereupon the infra red sensor 125A signals the controller 131 to operate motor M1 for indexing pusher P1 forward one step to deliver the stack RS2 to dispensing position, and index reserve stack RS3 one step forward to ready position. Further vends calling for A cups take place from the stack at 0A until that stack is depleted, whereupon the infra red sensor 125A signals the controller 131 to operate motor M2 for indexing the second pusher P2 to deliver reserve stack RS5 to dispensing position, and to index reserve stack RS6 one step forward to ready position. Further vends calling for A cups take place from the stack at 0A until that stack is depleted whereupon the infra red sensor 125A signals the controller 131 to operate motor M1 for indexing the first pusher P1 to deliver reserve stack RS3 to dispensing position, calling for A cups take place and further vends from the stack at 0A until that stack is depleted whereupon the infra red sensor 125A signals the controller to operate motor M1 for indexing the second pusher P2 to deliver reserve stack RS6.

On selection of vends calling for B size cups, switch 129 closes for operation of dispenser 3B in a manner similar to that of dispenser 3A.

Instead of alternating delivery of reserve stacks RS1-RS6 as above noted (Rs1, RS4, RS2, RS5, RS3, RS6) it is possible that delivery of the reserve stacks may be carried out in the order RS1-RS6 by so programming the controller. Alternation in delivery is preferred. It is also possible that both dispensers 1A and 1B may dispense the same size of cups, e.g. by delivering reserve stacks in the order RS1, RS7, RS2, RS8, RS3, RS9, RS4, RS5 and RS6.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A cup dispenser for dispensing cups from a stack of nested cups each of which has a rim comprising a base having a cup dispensing opening;

dispensing means at the opening for holding up the lowermost cup of a stack in dispensing position by the rim of the lowermost cup in the opening and thereby holding up the stack in dispensing position generally in line with the opening;

said dispensing means being operable to release the lowermost cup of the stack in dispensing position to drop down from the base and to hold up the next cup by its rim and thereby hold up the remainder of the stack;

first means for holding a first reserve stack adjacent the opening;

second means for holding a second reserve stack adjacent the opening, and means operable in response to depletion of the stack in dispensing position to move one or the other of the reserve stacks into dispensing position;

the cup dispensing opening being located between said first and second reserve stack holding means for movement of said first reserve stack into dispensing position in said dispensing opening and for movement of said second reserve stack into dispensing position in said dispensing opening;

said means operable in response to depletion of the stack in dispensing position being operable to move said first reserve stack from its position adjacent said dispensing opening to dispensing position in said dispensing opening in a first path which intersects said dispensing opening, and to move said second reserve stack from its position adjacent said dispensing opening to dispensing position in said dispensing opening in a second path which intersects said opening.

2. A cup dispenser as set forth in claim 1 wherein said first stack holding means is constructed to hold a first set of reserve stacks adjacent the opening and said second stack holding means is constructed to hold a second set of reserve stacks adjacent the opening, and wherein the means operable in response to depletion of the stack in dispensing position is operable to move one or the other of said first and second sets of reserve stacks to bring one stack thereof from a ready position into dispensing position and another stack thereof into ready position for being the next of the respective set to move into dispensing position.

3. A cup dispenser as set forth in claim 2 wherein the reserve stacks of each set are positioned extending upward at intervals around a vertical axis for travel in a circular path which intersects said opening, and wherein the means for moving each set is operable for indexing it through one interval on each operation thereof.

4. A cup dispenser as set forth in claim 3 wherein each means for holding a set of reserve stacks comprises a shaft extending up from the base rotatable on said vertical axis, partitions extending generally radially outwardly from the shaft, the partitions being angularly spaced with spaces between them each accommodating a reserve stack extending up from the base, the indexing means for each set of stacks comprising means for rotating the respective shaft through an angle corresponding to the angular spacing of the partitions on each operation thereof in response to depletion of the stack in dispensing position.

5. A cup dispenser as set forth in claim 4 having means for causing the reserve stacks to lean inward in said spaces in the direction toward the respective shaft.

6. A cup dispenser as set forth in claim 4 having plates of circular outline on the base coaxial with each shaft, the lower ends of each reserve stack being movable around on the respective plate, each plate having a raised rim for holding the stack leaning inward in the respective space toward the respective shaft, each plate having a cut-out at the dispensing opening.

7. A cup dispenser as set forth in claim 6 further having an inclined guide at the lower end of each space in each reserve stack holding means engageable by the lower end of the reserve stack in the respective space for holding the stack in said leaning-inward position in conjunction with the raised rim on said plate.

8. A cup dispenser as set forth in claim 4 wherein the indexing means for each set of stacks comprises a Geneva drive having a drive wheel and an indexing wheel at the lower end of each shaft.

9. A cup dispenser as set forth in claim 8 wherein each means for holding a set of reserve stacks has four of said partitions defining four spaces spaced at 90° intervals for holding a set of three reserve stacks, and the Geneva drive mechanism for each set is constructed to index it in 90° steps.

10. A cup dispenser as set forth in claim 1 having a second cup dispensing opening in the base, second dispensing means at the second opening for holding up the lowermost cup of a stack in dispensing position in the second opening by the rim of the lowermost cup in the second opening and thereby holding up the stack in the second opening generally in line therewith, said second dispensing means being operable to release the lowermost cup of the stack in dispensing position in the second opening to drop down from the base and to hold up the next cup by its rim and thereby hold up the remainder of the stack, third means for holding a third reserve stack adjacent the second opening, and means operable in response to depletion of the stack in dispensing position in the second opening to move the reserve stack into dispensing position in the second opening.

11. A cup dispenser as set forth in claim 10 wherein said third holding means is constructed to hold a third set of reserve stacks adjacent said second opening wherein the means operable in response to depletion of the stack in dispensing position in the second opening is operable to move the third holding means for bringing one of the reserve stacks therein into dispensing position in the second opening.

12. A cup dispenser as set forth in claim 11 wherein the reserve stacks of said third set are positioned extending upward at intervals around a third vertical axis for travel in a circular path which intersects said second opening, and wherein the means for moving said third set is operable for indexing it through one interval on each operation thereof.

13. A cup dispenser as set forth in claim 12 wherein said third means for holding said third set of reserve stacks comprises a third shaft extending up from the base rotatable on said third vertical axis, partitions extending generally radially outwardly from said third shaft, the partitions being angularly spaced with spaces between them each accommodating a reserve stack extending up from the base, the indexing means for said third set of stacks comprising means for rotating the respective shaft through an angle corresponding to the angular spacing of the partitions on each operation thereof in response to depletion of the stack in dispensing position in the second opening.

14. A cup dispenser as set forth in claim 13 having means for causing the reserve stacks of the third set to lean inward in said spaces in the direction toward the respective shaft.

15. A cup dispenser as set forth in claim 13 having a plate of circular outline on the base coaxial with the third shaft, the lower end of each reserve stack in the third set being movable around on the respective plate, said plate having a raised rim for holding the stack leaning inward in the respective space toward the respective shaft, said plate having a cut-out at the second dispensing opening.

16. A cup dispenser as set forth in claim 15 further having an inclined guide at the lower end of each space in the third reserve stack holding means engageable by the lower end of the reserve stack in the respective space for holding the stack in said leaning-inward position in conjunction with the raised rim on said plate.

17. A cup dispenser as set forth in claim 13 wherein the indexing means for the third set of stacks comprises a Geneva drive having a drive wheel and an indexing wheel at the lower end of the third shaft.

18. A cup dispenser as set forth in claim 17 wherein the means for holding the third set of reserve stacks has four of said partitions defining four spaces spaced at 90° intervals for holding a set of three reserve stacks and the Geneva drive mechanism for that set is constructed to index it in 90° steps.

* * * * *